United States Patent [19]

Gettler

[11] Patent Number: 4,858,354

[45] Date of Patent: Aug. 22, 1989

[54] ORGANIZATION SYSTEM

[76] Inventor: Lawrence H. Gettler, 8 Gilbert St., San Rafael, Calif. 94901

[21] Appl. No.: 23,483

[22] Filed: Mar. 9, 1987

[51] Int. Cl.[4] ..... G09F 3/00

[52] U.S. Cl. ..... 40/324; 40/491; 40/359; 312/209

[58] Field of Search ..... 40/324, 359, 375, 491, 40/904, 360, 488; 312/140.4, 209, 234, 234.4; 206/557, 562; 108/26; 116/321, 323; 220/23.2

[56] References Cited

U.S. PATENT DOCUMENTS

| | | | |
|---|---|---|---|
| 2,288,728 | 7/1942 | Meredith | 40/491 |
| 2,731,941 | 1/1956 | Anderson | 40/491 |
| 2,918,294 | 12/1959 | Hennion | 280/33.99 A |
| 3,219,009 | 11/1965 | Olsen | 40/359 |
| 3,393,030 | 7/1968 | Block | 312/209 |
| 3,397,434 | 8/1968 | Arblaster | 40/488 |
| 3,748,767 | 7/1973 | Giesecke | 40/491 |
| 3,769,727 | 11/1973 | Kent, Jr. | 40/488 |
| 4,041,893 | 8/1977 | Mulloy | 128/1 R |
| 4,582,018 | 4/1986 | Fleck et al. | 116/321 |
| 4,630,769 | 12/1986 | Ball | 232/19 |
| 4,654,990 | 4/1987 | Suters | 40/491 |
| 4,656,765 | 4/1987 | DeBoer | 40/491 |

*Primary Examiner*—Gene Mancene
*Assistant Examiner*—Cary E. Stone
*Attorney, Agent, or Firm*—Larry D. Johnson

[57] ABSTRACT

An organization system includes a series of covered, side-by-side "status-tracking" filing trays, open at each end, for placement on an existing countertop (thus, the top surface of the covered trays continues to provide a flat working surface for that counter). Each filing tray corresponds to a given subject, and each contains a filing tray clipboard for holding the file pertaining to that subject. Above each tray is at least one symbol display mechanism, so that the status of the subject on different parameters can be displayed and monitored visually from a distance. The display mechanism depicts the status of these parameters by display of an appropriate symbol or color, for example, as follows: no display color (no action necessary); red display color (orders requested); yellow display color (orders acknowledged or in progress); and green display color (orders complete). A further set of stand-alone status-tracking clipboards for extra subjects is provided, which incorporate symbol display mechanisms onto the board itself.

8 Claims, 3 Drawing Sheets

ORGANIZATION SYSTEM

BACKGROUND OF THE INVENTION

1. Field of the Invention

This invention relates generally to organizational and filing systems, and more specifically to an improved apparatus and method for organizing and tracking critical information on several parameters in a business setting, particularly the efficient handling of charts and tests in a hospital.

2. Description of the Prior Art

Numerous filing and office organization systems have been developed to improve efficiency and prevent information loss in the workplace. However, most such systems are designed for and work best in a static, "office" environment, and are not readily adaptable to service-oriented or other busy, dynamic settings, such as those that exist in a hospital emergency room. In such an environment, great care must be taken to keep track of all of the charts, files, and other documents, while still enabling quick and accurate disposition of requests and instructions.

SUMMARY OF THE INVENTION

The organization system of this invention provides a structure and method for the filing, processing, and communication of information and notification of necessary business procedures, and is particularly adaptable to organizing the flow of information and services in the emergency department of a hospital, such as the systematic triage and treatment of emergency room patients. Structurally, the organization system includes a series of covered, side-by-side "status-tracking" filing trays, open at each end, for placement on an existing countertop (thus, the top surface of the covered trays continues to provide a flat working surface for that counter). Each filing tray corresponds to an emergency room bed, and each contains a filing tray clipboard for holding the file of the patient assigned to that bed. Above each tray is at least one symbol display mechanism, so that the status and progress of the patient on different parameters (e.g., nursing instructions, ancillary tests, and the like) can be displayed and monitored visually from a distance. The display mechanism depicts the status of these parameters by display of an appropriate symbol or color, for example, as follows: no display color (no action necessary); red display color (orders requested); yellow display color (orders acknowledged or in progress); and green display color (orders complete). Thus, emergency room doctors, nurses, and attendants alike can tell at a glance, even from across the room, the status of the beds and work-in-progress in the emergency room. In addition, the filing tray clipboards containing the charts and forms of interest are accessible from either side of the counter.

A further set of stand-alone status-tracking clipboards for overflow patients is provided, which incorporate symbol display mechanisms onto the board itself, for use with patients who for one reason or another are not assigned to a particular bed. Thus, these status-tracking boards are capable of containing and displaying the same information as the status-tracking filing trays and their corresponding filing tray clipboards, but are suitable for use in the field, on a hospital guerney, or the like. In this way, a given status-tracking clipboard can "stay" with a given patient from the scene of an accident or other medical emergency (where, for example, a paramedic can initiate the nursing and ancillary requests) to the hospital, without having to manually transfer the data or requests.

The symbol display mechanisms utilized on the status-tracking filing trays and status-tracking boards of the organization system can of course be constructed in many forms. In the preferred embodiment, the display mechanism comprises a strip member partitioned into panels bearing appropriate colors (e.g., red/yellow/green), which is slidable from within an opaque cover portion to selectively display the desired color panel(s). This sliding-type display mechanism is thus suitable for "stacking" one mechanism atop another, and therefore, in combination, can be used to track an essentially unlimited number of variables within the system. For example, one display mechanism can be used to track the status of nursing instructions, another used to track the status of ancillary tests, and so forth. The various display mechanisms can be differentiated from one another by appropriate symbols or colors placed, for example, on their respective opaque cover portions.

A set of wall racks is provided to further enhance the organizational structure of the system. For example, a "nurse" wall rack vertically orders and displays the charts of registered but as yet unevaluated patients. A "doctor" wall rack similarly vertically orders and displays the chart of the next patient to be evaluated by a doctor. Thus, the charts in the "doctor" wall rack may be on a filing tray clipboard (for those patients assigned to one of the numbered beds), or on a status-tracking board (for patients not so assigned).

In emergency room applications, a suitably-designed x-ray rack should be installed near the other components of the organization system. The x-ray rack displays and holds the x-ray film results corresponding to particular emergency room beds (and/or overflow patients), thus complementing the ordered information flow of the system.

BRIEF DESCRIPTION OF THE DRAWINGS

FIG. 2*a* is a view from in front of the counter on which the tray is installed; and FIG. 2*b* is a view from behind the counter;

FIG. 4*a* is an elevated front view; and

FIG. 4*b* is an elevated rear view;

DETAILED DESCRIPTION OF A PREFERRED EMBODIMENT

Figure 1:
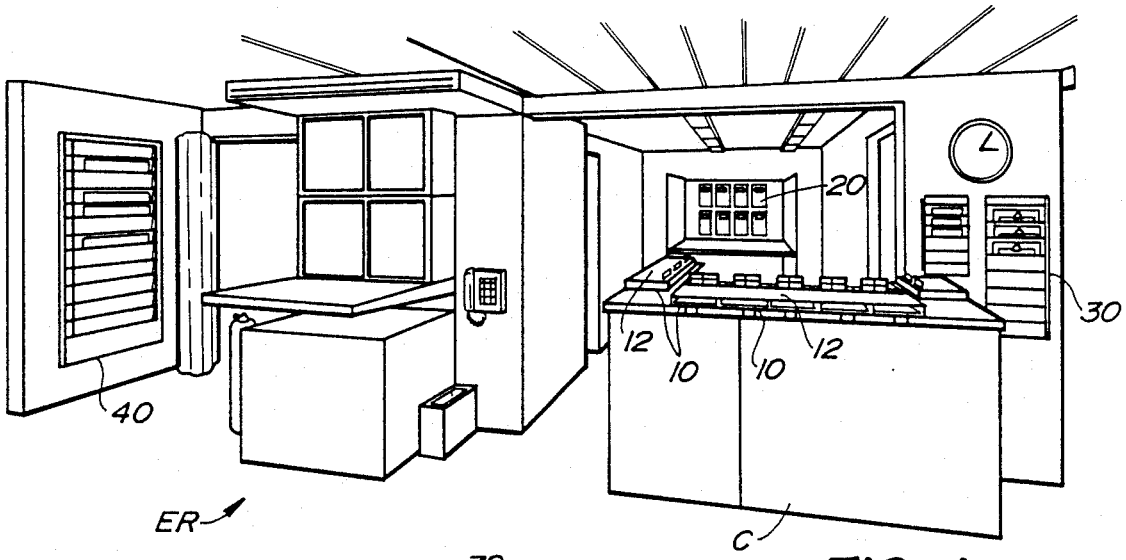
FIG. 1 is a perspective view of a typical installation of the organization system of this invention in a hospital emergency room, illustrating the various components of the system as available for use.
Figure 2A:
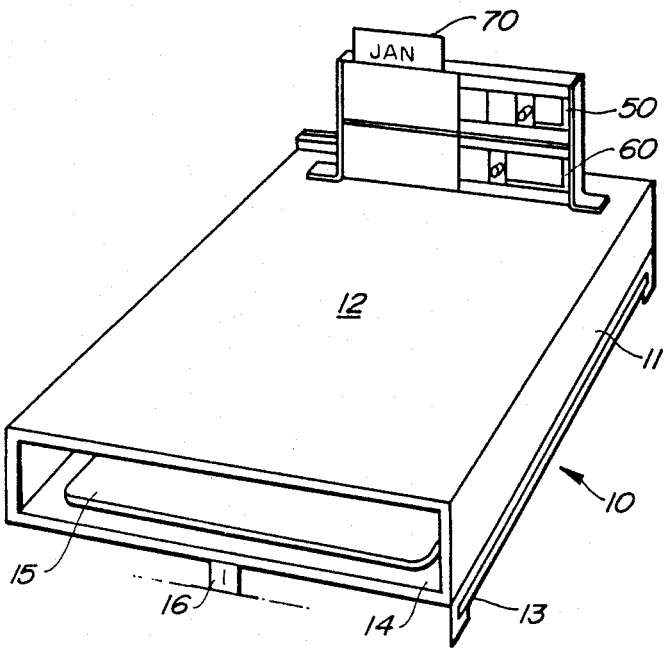
FIGS. 2*a–b* are perspective views of a status-tracking filing tray of the organization system.
Figure 2B:
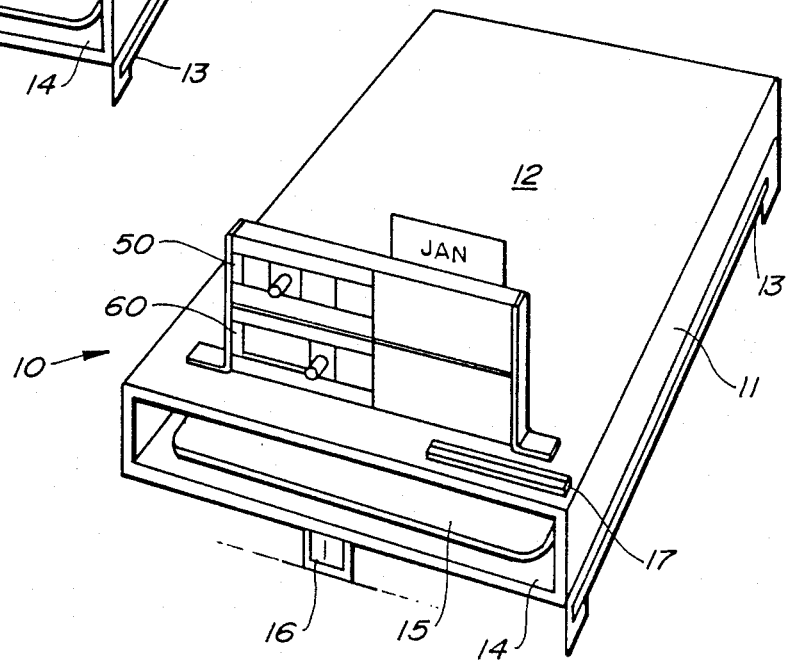

FIG. 1 illustrates the various components of the organization system as installed in a typical hospital emergency room ER. A series of side-by-side, status-tracking filing trays 10 are shown on top of counter C. There are preferably the same number of trays as there are corresponding beds in the emergency room. The trays are open at both ends so that material can be placed into and retrieved from either side of the counter. The trays are each covered by a top surface 12, so as to continue to provide a writing and working surface above the counter on which they are installed.

Stand-alone status-tracking clipboards 20 are shown as they might be mounted for display and use on a wall. These stand-alone boards can thus be designated for use with "overflow" patients not assigned to a particular bed.

Organizational wall racks 30 can be installed near the filing trays 10 to vertically order and display charts for patients awaiting evaluation. Finally, x-ray rack 40 can be installed near the filing trays to display and hold x-ray film results corresponding to particular beds or overflow patients.

FIGS. *2a–b* are perspective views of a status-tracking filing tray 10; FIG. *2a* as viewed from in front of the counter, and FIG. *2b* as viewed from behind the counter. The trays are preferably constructed of high quality acrylic or other strong, transparent material, so that the contents of the trays can be seen from the outside. Tray 10 includes body portion 11 and top surface 12, and can be securely mounted to a counter by use of a tongue-and-groove mounting runner 13 or other means. By such installation, the respective side-by-side trays 10 can be individually replaced as necessary simply by sliding the trays out from a track built into the counter. The hollow, internal void 14 of the trays is accessible from either end, and is used to hold a filing tray clipboard 15. Each tray (and the clipboard contained within) can be numbered with indicia 16 to correspond to a particular bed in the emergency room. The trays may also include a slit 17 on their upper surface to hold a patient's addressograph card.

Mounted to each of the trays are a pair of symbol display mechanisms 50, 60, used for tracking the status of two distinct parameters of the work-in-progress for a given patient. Here, display mechanism 50 is used to track the status of nursing orders, while display mechanism 60 is used to track the status of ancillary (e.g., lab) orders. Of course, any number of display mechanisms could be combined to track any number of work-in-progress variables. As shown, the display mechanism's display their symbol (color) in both directions, that is, in front of and behind the counter on which the tray is installed. A magnetized name tag 70 or other indicia-bearing marker can be attached to the display mechanism to designate, for example, that a particular nurse is primarily responsible for that patient.

Figure 3:
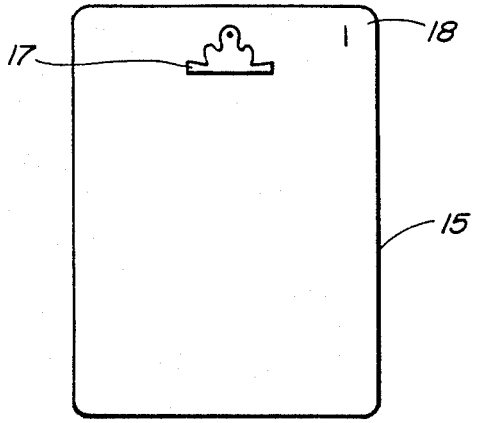
FIG. 3 is an elevated front view of a filing tray clipboard of the organization system.
Figure 4A:
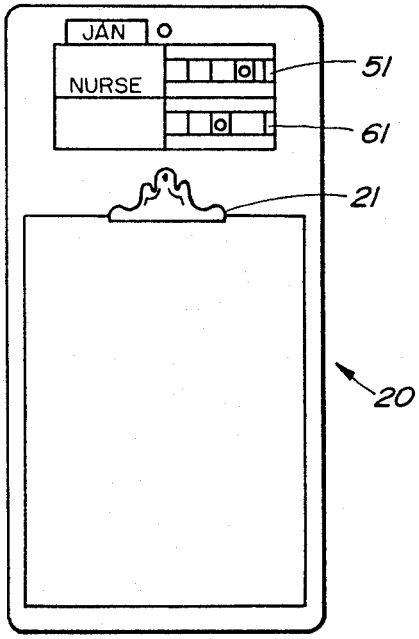
FIGS. 4*a–b* are elevated views of a status-tracking clipboard of the organization system.
Figure 4B:
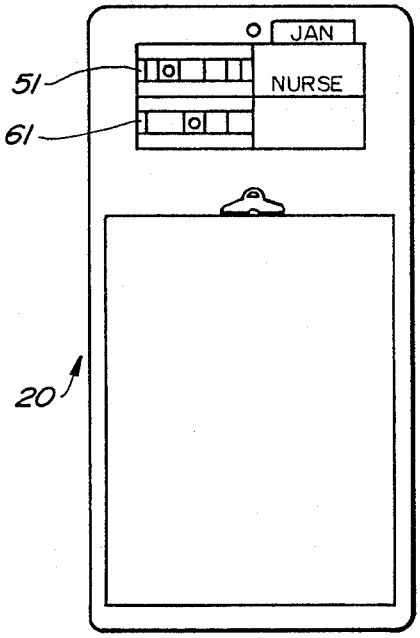

FIG. 3 illustrates a filing tray clipboard 15 as removed from its filing tray. Clipboard 15 includes a standard spring-type clip 17 for retaining charts, forms, and the like, relating to the assigned patient. Clipboard 15 is numbered with indicia 18 to correspond to the filing tray it came from, which in turn corresponds to a particular bed in the emergency room.

FIGS. *4a–b* are front and rear elevated views, respectively, of a status-tracking clipboard 20, used for "overflow" patients. Status-tracking clipboard 20, like standard clipboard 15, includes a spring clip 21 for retaining charts and forms. However, status-tracking clipboard 20 also includes symbol display mechanisms 51, 61, which are analogous to the symbol display mechanisms 50, 60 used on tray 10. Thus, status-tracking clipboard 20 performs the same functions as tray 10: retention of charts, and tracking of work-in-progress status. Status-tracking board 20 is preferably made of transparent material so that display mechanisms 51, 61 are visible from either side of the board. Alternatively, display mechanisms 51, 61 could be mounted flush into the board 20, so that it's symbols or colors are displayed to both sides.

Figure 5:
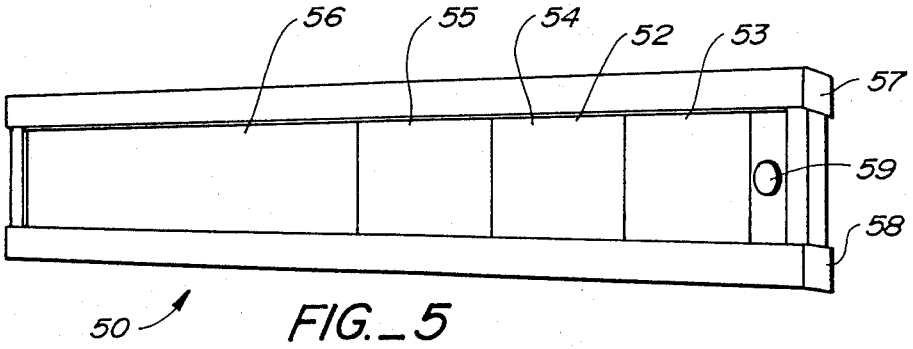
FIG. 5 is a perspective view of a color-coded sliding version of a symbol display mechanism of the organization system.

FIG. 5 is a perspective view of a color-coded sliding version of a symbol display mechanism. Display mechanism 50 includes a strip member 52, which is partitioned into a red panel 53, yellow panel 54, and green panel 55. Strip 52 is selectively moved from behind an opaque cover 56 to display one or more of these colors, to indicate progress of a task. Upper and lower display housings 57, 58 serve to guide the sliding strip in and out of the opaque cover, and include stop positions (not shown) along the strip's extension to prevent inadvertant movement of the strip. Knob 59 provides a convenient grip to the user to move the strip.

Figure 6:
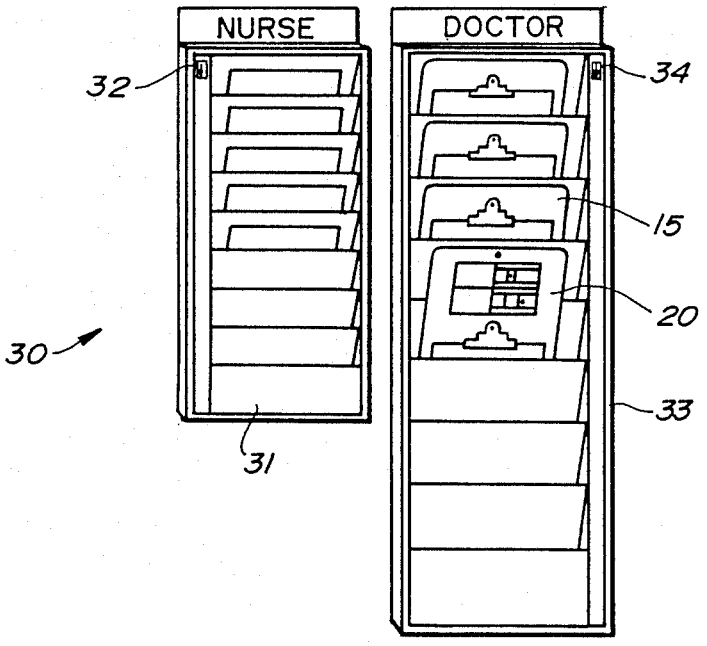
FIG. 6 is a perspective view of a wall rack of the organization system.

FIG. 6 is a perspective view of a set of wall racks 30 used to complement the organizational structure of the system. Nurse rack 31 arranges the charts of registered but as yet unevaluated patients, and includes a movable marker 32 to indicate the order of preference. Doctor rack 33 similarly arranges the charts of patients needing a doctor's evaluation, and also has a movable marker 34. The doctor rack is specifically constructed to accomodate either standard filing tray clipboards 15 or status-tracking clipboards 20.

Figure 7:
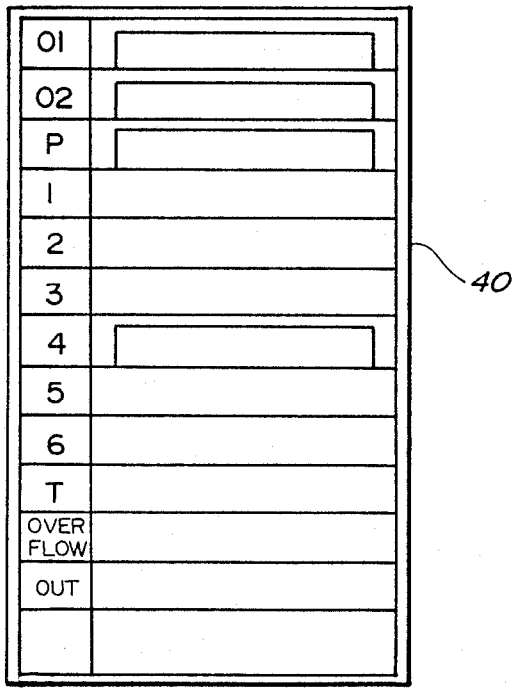
FIG. 7 is an elevated front view of an x-ray rack of the organization system.

FIG. 7 is a front view of an x-ray rack 40, used to display and hold x-ray films corresponding to emergency room beds, as well as overflow patients, and thus mimics the overall system.

While this invention has been described in connection with preferred embodiments thereof, it is obvious that modifications and changes therein may be made by those skilled in the art to which it pertains without departing from the spirit and scope of the invention. For example, the organization system can be adapted for use in any business setting that requires the tracking of the status of an activity, be it the location of a file or the degree of assembly of an article of manufacture. Accordingly, the scope of this invention is to be limited only by the appended claims.

What is claimed as invention is:

1. An organization system for tracking the state of completion of an activity applicable to more than one subject, said activity having at least two states of completion, said system comprising:

a number of tray members equal to the number of subjects, said tray members arranged in side-by-side fashion upon a counter, said tray members including a top surface providing a working surface above said counter, and including a mounting device engageable to a tray connection device on said counter, and further including means for containing information relating to said subject; and a display mechanism for selectively revealing a symbol indicating the state of completion of said activity activities to be tracked.

2. The organizational system of claim 1 for tracking the state of completion of more than one activity applicable to said subject, including a number of display mechanism equal to the number of activities to be tracked.

3. The organizational system of claim 1 wherein said counter has at least two sides, and said tray members are accessible from either side.

4. The organizational system of claim 1 wherein said display mechanism is visible from either side of said counter.

5. The organizational system of claim 1 wherein said tray members are made of a transparent material.

6. The organizational system of claim 1 wherein said information containing means comprises a clipboard insertable within said tray members.

7. An organization board for tracking the state of completion of more than one activity applicable to a given subject, said activity having at least two states of completion, comprising:

a clipboard member with means for containing information relating to said subject, said clipboard member made of a transparent material; and a number of display mechanisms equal to the number of activities to be tracked, said display mechanisms mounted on said clipboard for selectively revealing a symbol indicating the state of completion of said activity, said display mechanisms visible through said clipboard transparent material.

8. A symbol display mechanism for selectively revealing a symbol indicating the state of completion of an activity, said display mechanism having a front side and a back side, comprising:

upper and lower housing members;

a strip member partitioned into panels bearing red, yellow and green symbols slidable within said housing members; and an opaque cover portion to obscure some or all of said strip member symbols, wherein said strip member is slidable within said housing members and completely behind said opaque cover portion to display no symbols indicative of completion of an activity, and slidable within said housing members and completely away from said opaque cover portion to simultaneously display symbols indicative of completion of the activity to both sides of said display mechanism, and further that said display mechanism is stackable upon other like display mechanisms to enable indications of completion of a plurality of activities.

* * * * *